US005803000A

United States Patent [19]

Morita

[11] Patent Number: 5,803,000

[45] Date of Patent: Sep. 8, 1998

[54] EMBROIDERY SEWING MACHINE

[75] Inventor: Nami Morita, Nagoya, Japan

[73] Assignee: Brother Kogyo Kabushiki Kaisha, Nagoya, Japan

[21] Appl. No.: 972,047

[22] Filed: Nov. 17, 1997

[30] Foreign Application Priority Data

Nov. 18, 1996 [JP] Japan ..... 8-306228

[51] Int. Cl.[6] ..... D05C 5/02; D05B 21/00; G06F 19/00

[52] U.S. Cl. ..... 112/102.5; 364/470.09

[58] Field of Search ..... 112/102.5, 470.06, 112/475.19, 456, 445, 458; 364/470.09

[56] References Cited

U.S. PATENT DOCUMENTS 4,858,542 8/1989 Kato et al. ..... 112/103 X
5,559,711 9/1996 Futamura et al. ..... 112/102.5

FOREIGN PATENT DOCUMENTS 3-184588 8/1991 Japan .
7-24160 1/1995 Japan .
7-3607 1/1995 Japan .

*Primary Examiner*—Peter Nerbun
*Attorney, Agent, or Firm*—Oliff & Berridge, PLC

[57] ABSTRACT

A household embroidery sewing machine includes an embroidery frame for holding a workpiece cloth, a needle bar, and a moving mechanism for moving either one or both of the embroidery frame and the needle bar relative to the other or each other so that an embroidery pattern is formed on the workpiece cloth. An embroidery pattern to be formed is selected. An occupied region within the workpiece cloth occupied by the selected embroidery pattern is obtained. A plurality of different sewable ranges are automatically set in a region defined by the embroidery frame. A control device judges within which of the set sewable ranges the occupied region of the selected embroidery pattern falls. A result of judgment is provided as information.

16 Claims, 15 Drawing Sheets

EMBROIDERY SEWING MACHINE

BACKGROUND OF THE INVENTION

1. Field of the invention

This invention relates to an embroidery sewing machine including a moving mechanism for moving either one of an embroidery frame holding a workpiece cloth and a sewing needle bar relative to the other so that a desired embroidery pattern on the workpiece cloth.

2. Description of the prior art

There has recently been provided a household embroidery sewing machine capable of sewing embroidery in a predetermined pattern, such as pictures and characters, on a workpiece cloth. The embroidery sewing machine sews the embroidery based on embroidery data corresponding to a plurality of types of patterns. The embroidery sewing machine comprises an embroidery frame provided on a sewing bed for holding a workpiece cloth and a frame moving mechanism provided on the sewing bed for moving the embroidery frame freely both in an X-axis direction, that is, frontward and rearward, and in a Y-axis direction, that is, leftward and rightward. The embroidery data is stored in an internal memory provided in the machine or an external memory medium such as a memory card. The embroidery sewing machine further comprises a microcomputer-based control device for retrieving a predetermined embroidery data and controlling a sewing needle drive mechanism, a cloth feed mechanism, a frame moving mechanism, etc. so that an embroidery is sewn on the workpiece cloth. The embroidery sewing machine is provided with two types of embroidery frames including a rectangular relatively large-sized frame and an elliptic small-sized frame used for a small workpiece cloth. Either frame is detachably attached to the frame moving mechanism.

The above-described embroidery sewing machine is provided with a display, such as a liquid crystal display (LCD) 16 (see FIG. 14) mounted on a front surface of the main body thereof. A number of embroidery patterns are displayed on a screen of the LCD 16, and a desired one of the patterns is selected on the screen by a user. The selecting operation may be repeated so that an embroidery pattern consisting of a combination of a plurality of characters or of a combination of a picture and character can be selected. Upon completion of the pattern selection by the user, the LCD 16 displays on its screen a layout region as shown in FIG. 14. The displayed layout region includes, on its left-hand end, a frame-shaped layout region A corresponding to a maximum sewable range when the large frame is used. A selected embroidery pattern B is displayed inside the layout region A on the screen. The displayed embroidery pattern B is a scaled down image of an embroidery to be actually sewn on the assumption that the layout region A is representative of the size of a workpiece cloth held by the embroidery frame (large frame). Accordingly, viewing the embroidery pattern B on the screen, the user can confirm an image of embroidery to be completed.

A generally square frame C encompassing the embroidery pattern B is also displayed on the screen. The frame C is representative of a region occupied by the embroidery pattern B. When a plurality of embroidery patterns are selected, occupied regions of the respective patterns are composed into a single square occupied region. The LCD 16 further displays on its screen a usable embroidery frame display D located on the right of the layout region A. On the basis of the size of the selected embroidery pattern B, the usable embroidery frame display D shows in the form of a picture which of the frames is usable or more specifically, whether both of the large and small frames are usable or whether only the large frame is usable. An error informing operation is executed when the selected embroidery pattern is beyond the range of the large frame. In this case, the microcomputer-based control device judges whether the selected embroidery pattern B can be sewn with the small frame. For this purpose, a rectangular sewable range F is set within an elliptic frame E which is sized to inscribe the small frame as shown by two dot chain lines in FIG. 15, the range F and frame E not being actually displayed on the screen. The judgment can readily be executed by comparing the coordinates of corners of rectangular sewable range F with those of the frame C.

In the above-described judging manner, however, the square sewable range F is set although an embroidery can originally be sewn within the elliptic sewable range E with regard to the small frame, thereby resulting in an increase in a so-called dead space. Consequently, in an increasing number of times, the small frame is judged to be unusable although the embroidery is originally sewable with use of the small frame. Almost all the dead space can be eliminated when both of the frames are formed into the rectangular shape. However, a circular or elliptic embroidery frame rather than a rectangular one is desirable to hold a relatively small workpiece cloth in a tight stretched state.

SUMMARY OF THE INVENTION

Therefore, an object of the present invention is to provide an embroidery sewing machine wherein the dead space can be rendered as small as possible when an embroidery pattern is formed on the workpiece cloth with an embroidery frame.

The present invention provides an embroidery sewing machine comprising an embroidery frame for holding a workpiece cloth, a needle bar, a moving mechanism for moving either one or both of the embroidery frame and the needle bar relative to the other or each other so that an embroidery pattern is formed on the workpiece cloth, pattern selecting means for selecting an embroidery pattern to be formed, means for obtaining an occupied region within the workpiece cloth occupied by the embroidery pattern selected by the pattern selecting means, range setting means for automatically setting a plurality of different sewable ranges in a region inside the embroidery frame, judging means for judging within which of the sewable ranges set by the range setting means the occupied region of the selected embroidery pattern falls, and informing means for informing a result of judgment by the judging means.

According to the above-described embroidery sewing machine, the range setting means sets the plurality of different sewable ranges in the region inside the embroidery frame. The judging means judges within which of the sewable ranges set by the range setting means the region occupied by the selected embroidery pattern falls. The plurality of sewable ranges can be set so as to cover a broader range of the region inside the embroidery frame even though a dead space is increased with respect to the individual sewable ranges. Consequently, the dead space in the region inside the embroidery frame can be rendered as small as possible.

The embroidery sewing machine preferably further comprises layout means for laying out the selected embroidery pattern so that the selected embroidery pattern is set on a desired location within the region inside the embroidery frame. In this case, the judging means judges within which of the sewable ranges set by the range setting means the occupied region of the embroidery pattern laid out by the layout means falls. A desired layout is carried out by the user, and then, the judgment by the judging means is made with respect to the post-layout embroidery pattern. Consequently, the convenience of the embroidery sewing machine can be improved.

The embroidery patterns preferably include a plurality of character patterns each having a rectangular occupied region of a predetermined size. The region inside the embroidery frame is preferably circular or elliptic, and the sewable ranges are preferably rectangular.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 2:
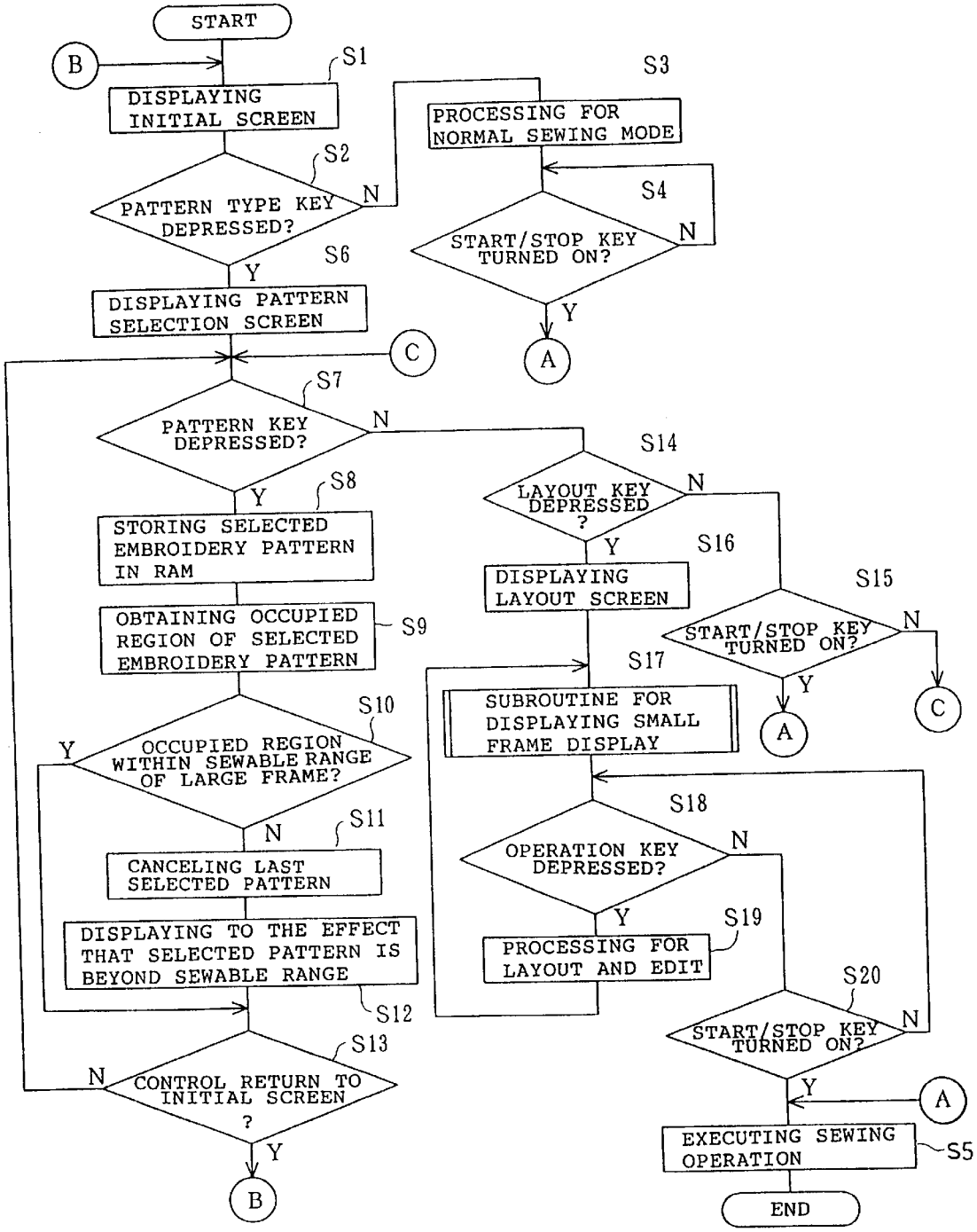
FIG. 2 is a flowchart showing a main routine for the processing from the time of power turn-on to the time of execution of sewing operation.
Figure 3:
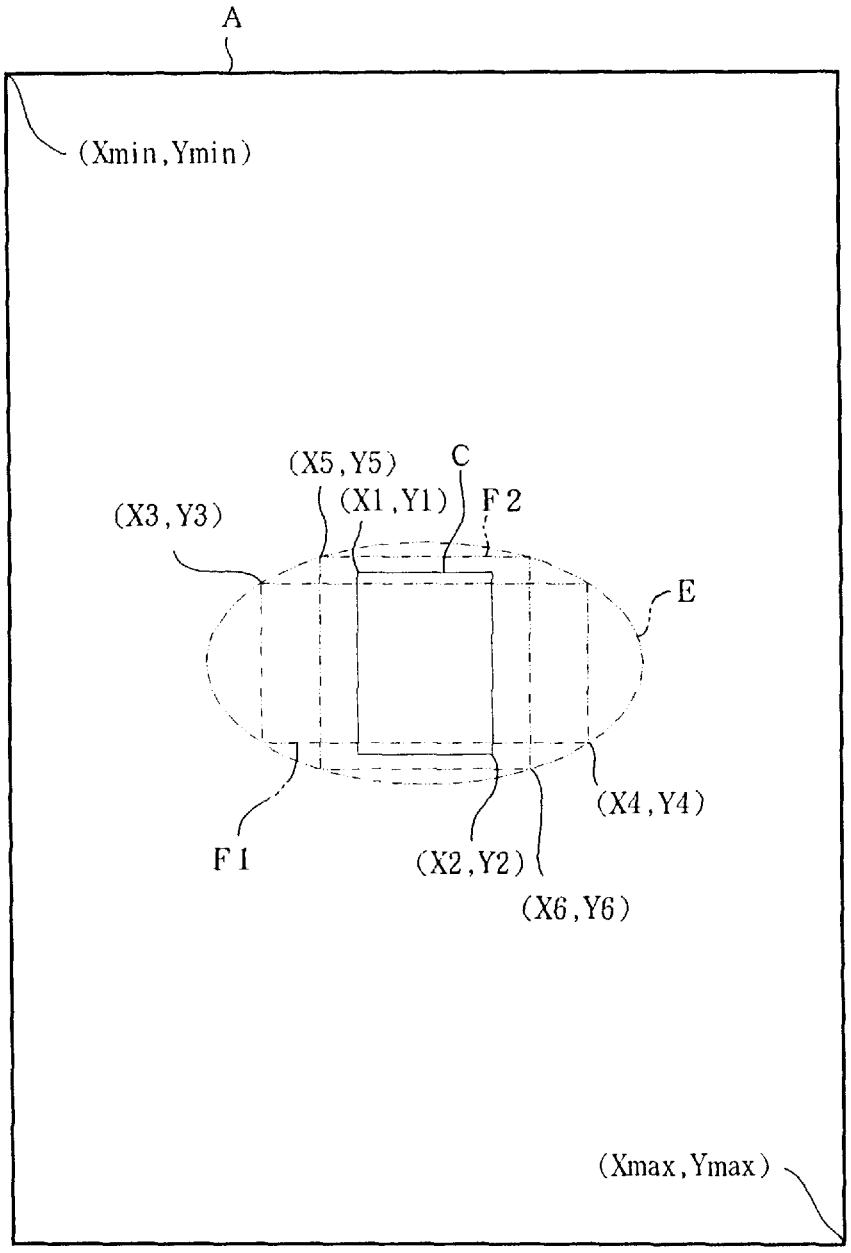
FIG. 3 is a view explaining a manner of setting and judging a sewable range.
Figure 4:
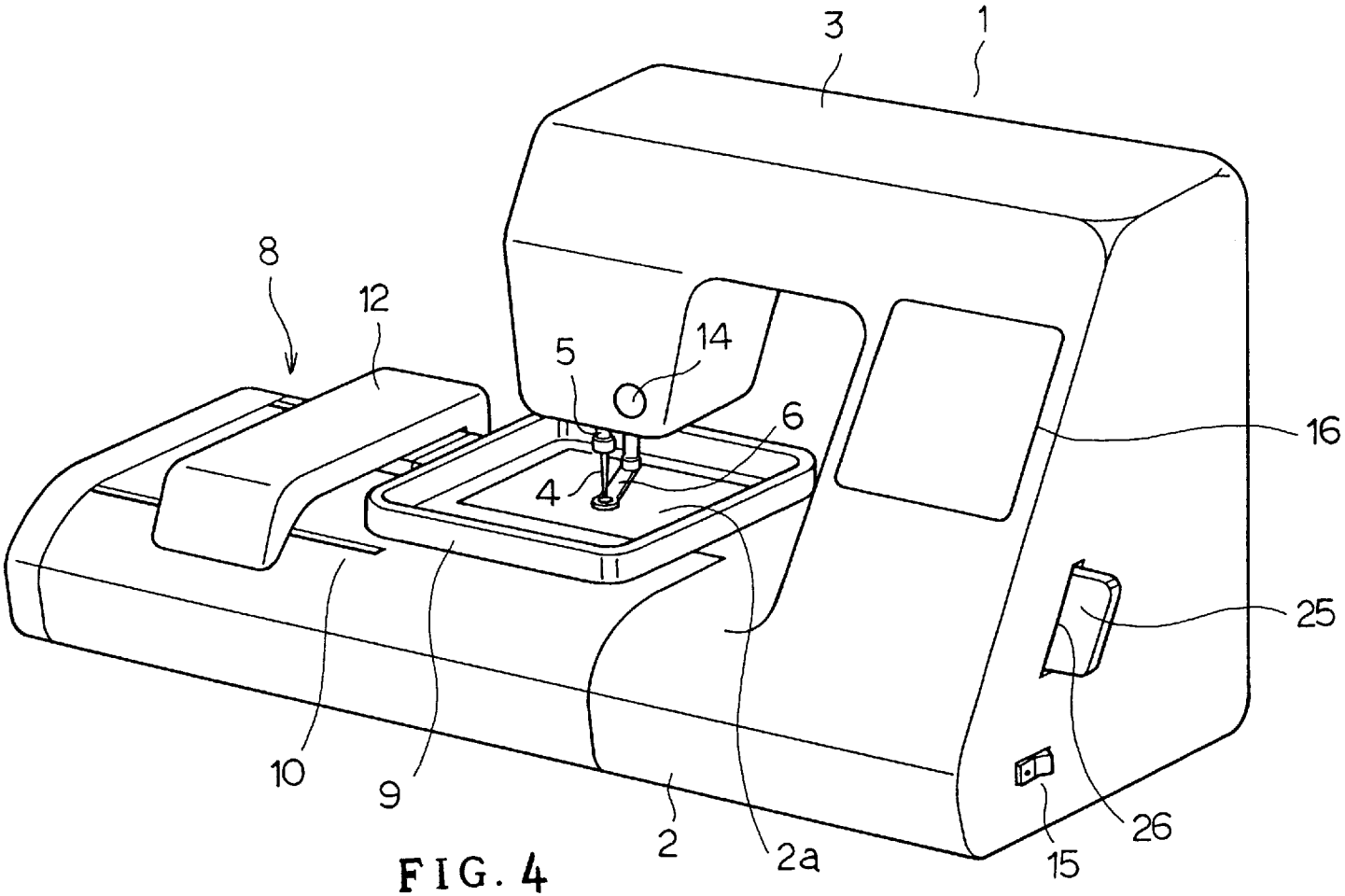
FIG. 4 is a perspective view of a main body of the embroidery sewing machine.
Figure 5:
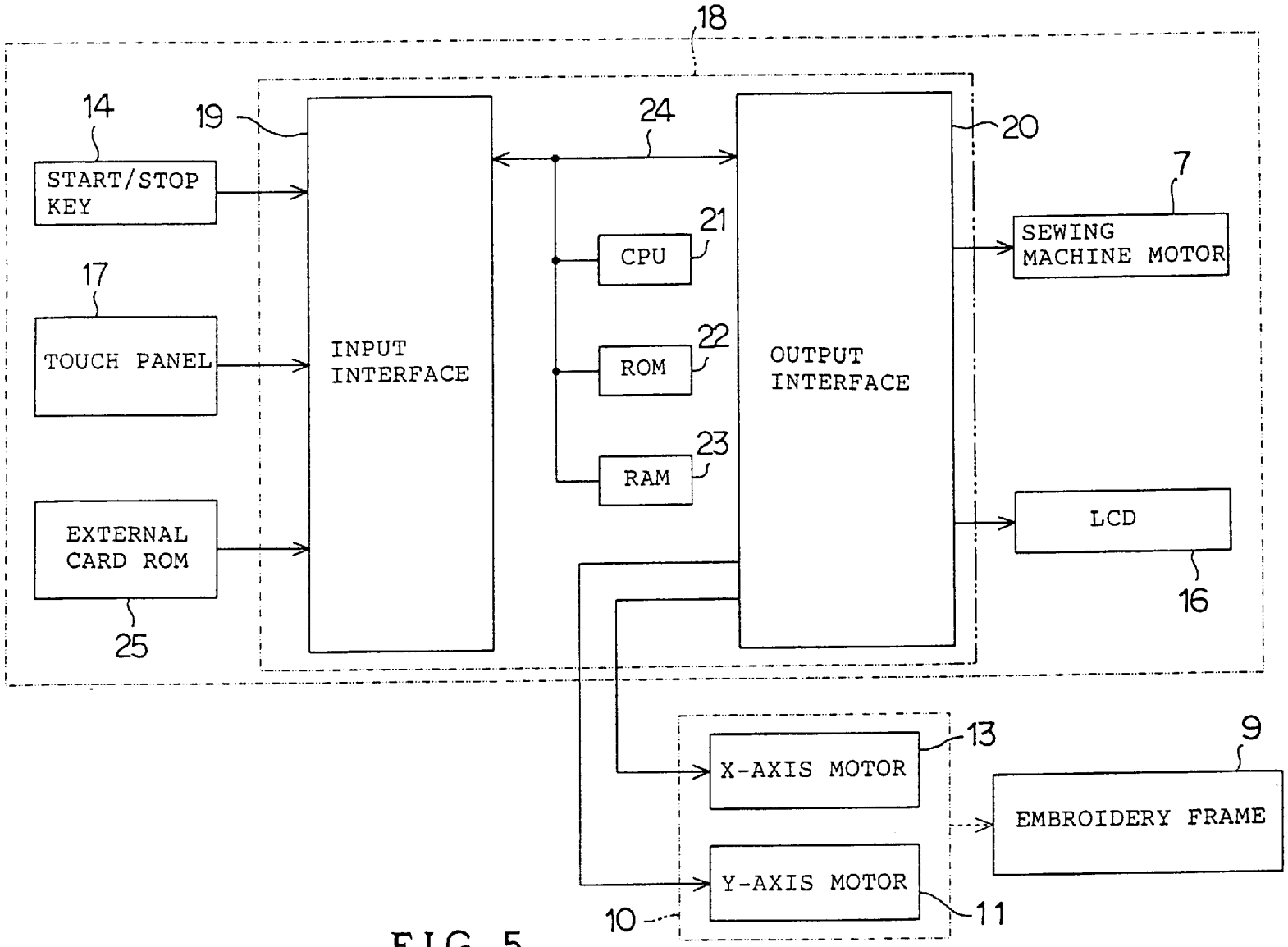
FIG. 5 is a block diagram showing an electrical arrangement of the embroidery sewing machine.

A first embodiment in accordance with the present invention will be described with reference to FIGS. 1 to 10. The invention is applied to a household embroidery sewing machine in the first embodiment. Referring first to FIG. 4, the embroidery sewing machine of the embodiment is schematically shown. A main body 1 of the embroidery sewing machine comprises a bed 2 and an arm 3 formed integrally with the bed 2. A distal end of the arm 3 is provided with a needle bar 5 having a sewing needle 4, and a presser foot 6 including a ring-shaped portion through which the needle 4 passes. The presser foot 6 applies a suitable force to a workpiece cloth (not shown) to bias a part of the workpiece cloth through which the needle 4 passes. A throat plate 2*a* is mounted on an upper surface of the bed 2 so as to correspond to the needle bar 5. A shuttle mechanism (not shown) is provided at a position under the throat plate 2*a*. The needle bar 5, shuttle mechanism, presser foot 6, etc. are synchronously driven via a drive mechanism (not shown) by a sewing machine motor 7 (see FIG. 5) so that a sewing operation is executed.

An embroidering unit 8 is detachably attached to a left-hand end of the bed 2. The embroidering unit 8 comprises an embroidery frame 9 for holding the workpiece cloth and an embroidery frame moving mechanism 10 for moving the embroidery frame 9 and accordingly, the workpiece cloth freely horizontally, that is, in an X-axis direction and a Y-axis direction over the bed 2. The embroidery frame 9 includes an outer frame and an inner frame between which the workpiece cloth is sandwiched, so that the workpiece cloth can be held tightly stretched inside the embroidery frame 9 between the frame and the throat plate 2*a*. The embroidery sewing machine of the embodiment is equipped with two types of embroidery frames 9, that is, a rectangular relatively large frame as shown in FIG. 4 and a relatively small frame (not shown) used to embroider a small workpiece cloth such as a pocket cloth. These embroidery frames 9 are replaceable with each other. The small embroidery frame is configured into an elliptic shape in the embodiment.

The embroidery frame moving mechanism 10 comprises a movable member 12 moved by an X-axis motor 13 (shown only in FIG. 5) freely in the X-axis direction, that is, leftward and rightward as viewed in FIG. 4. The moving mechanism 10 further comprises another movable member (not shown) provided in the movable member 12 to be moved by a Y-axis motor 11 (shown only in FIG. 5) freely in the X-axis direction, that is, frontward and rearward. The embroidery frame 9 is detachably attached to the movable member provided in the movable member 12. Consequently, the workpiece cloth held by the embroidery frame 9 can be moved by the embroidery frame moving mechanism 10 to an optional position based on an intrinsic X-Y coordinate system. An embroidering operation is performed when the needle bar 5, shuttle mechanism, presser foot, etc. are driven by the drive mechanism while the workpiece cloth is moved freely relative to the needle bar 5 by the embroidery moving mechanism 10.

A start/stop key 14 is provided on a front surface of the distal end of the arm 3. A power switch 25 is provided on the lower right-hand side surface of the machine main body 1. The embroidery sewing machine of the embodiment is capable of performing a variety of normal sewing operations such as straight stitching, zigzag stitching and overcast stitching as well as embroidering. In case that the embroidering is not carried out, the embroidering unit 8 is removed from the bed 2 to be replaced by a flat table (not shown) for the normal sewing operation.

Figure 7:
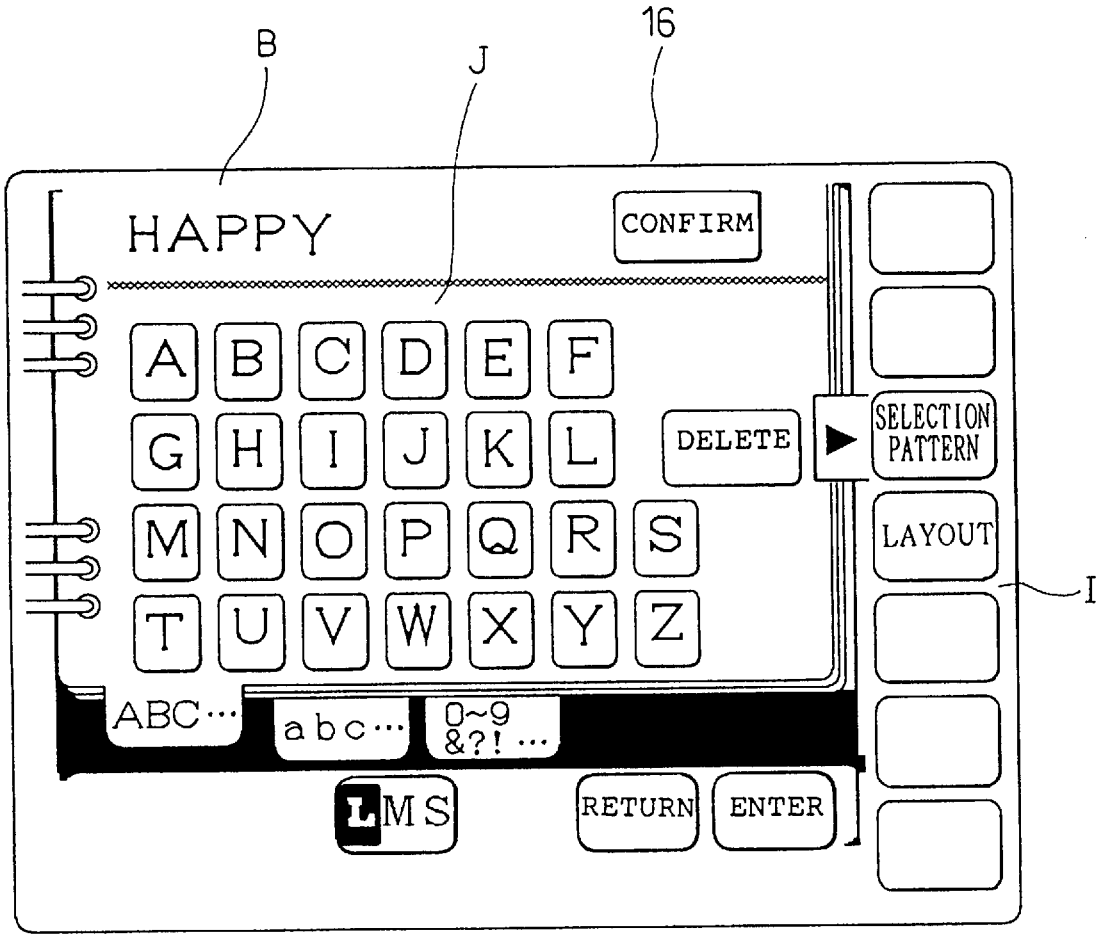
FIG. 7 is a view showing an embroidery selection screen of the LCD.
Figure 8:
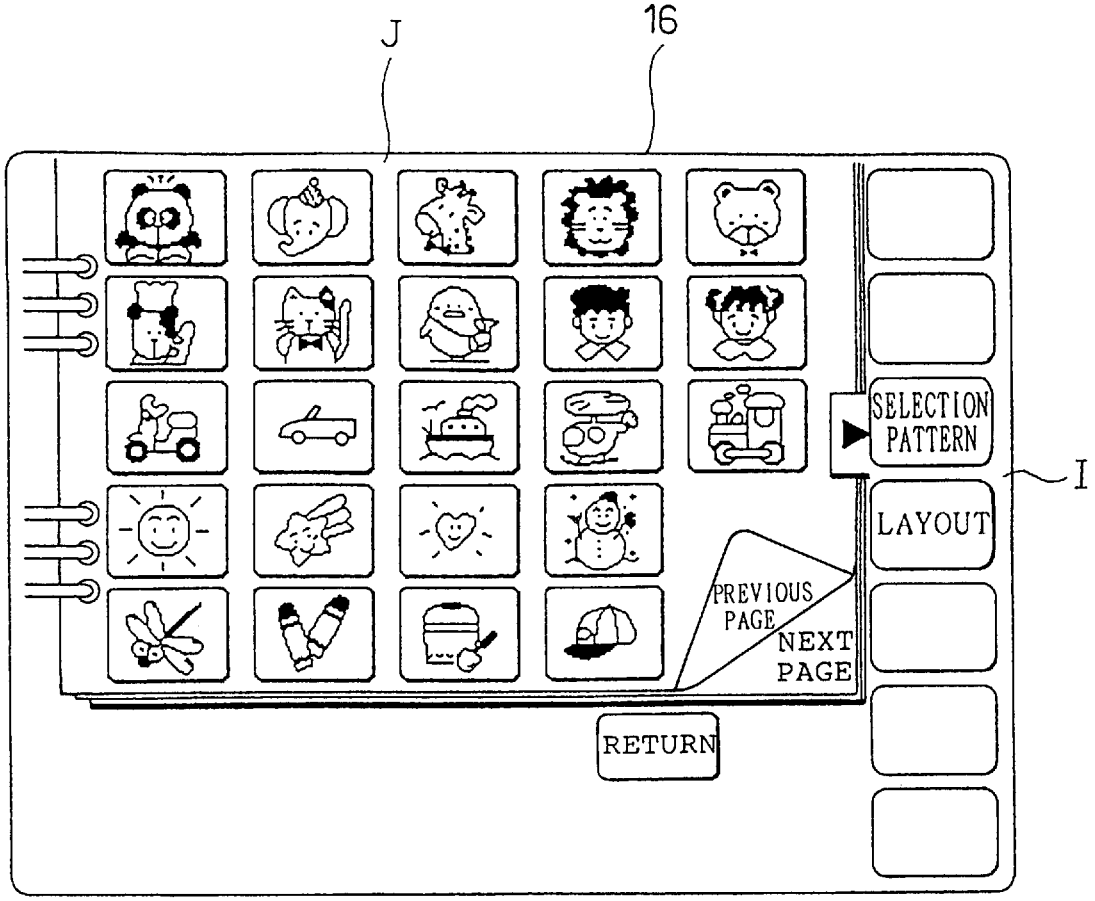
FIG. 8 is a view showing another embroidery selection screen.
Figure 9:
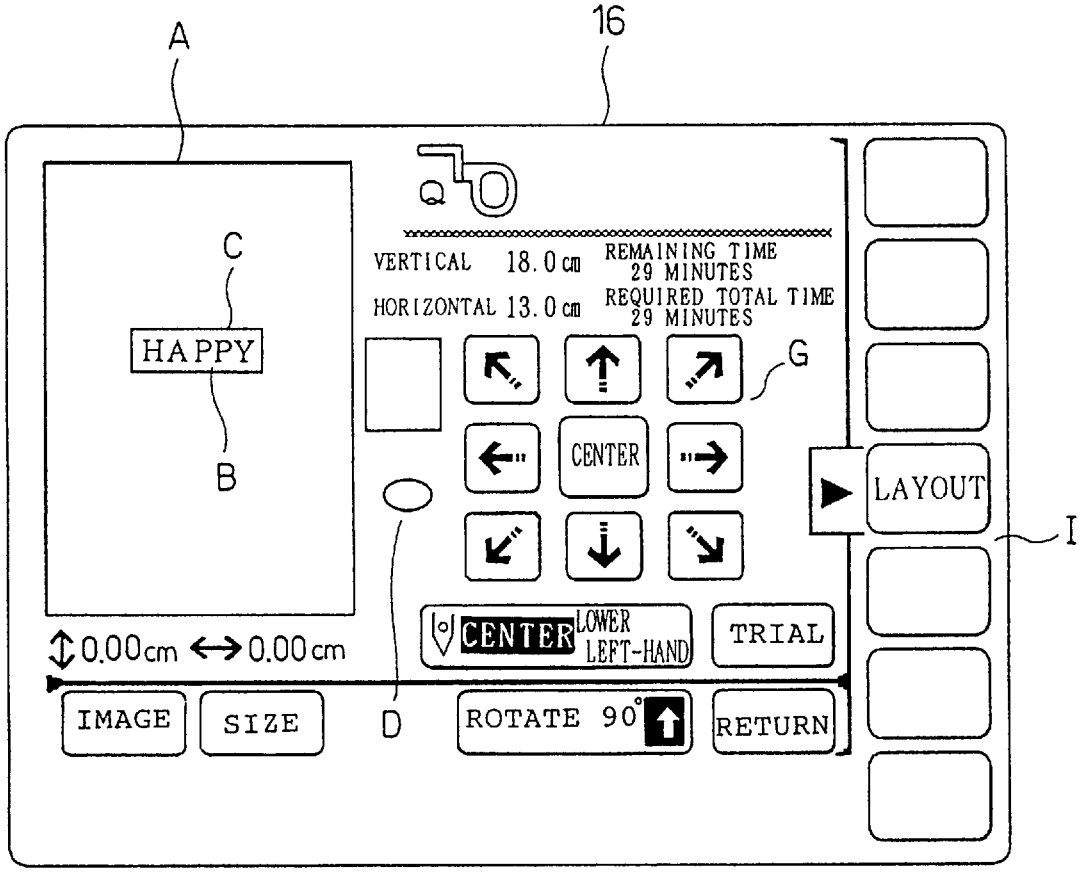
FIG. 9 is a view showing a layout screen of the LCD.
Figure 10:
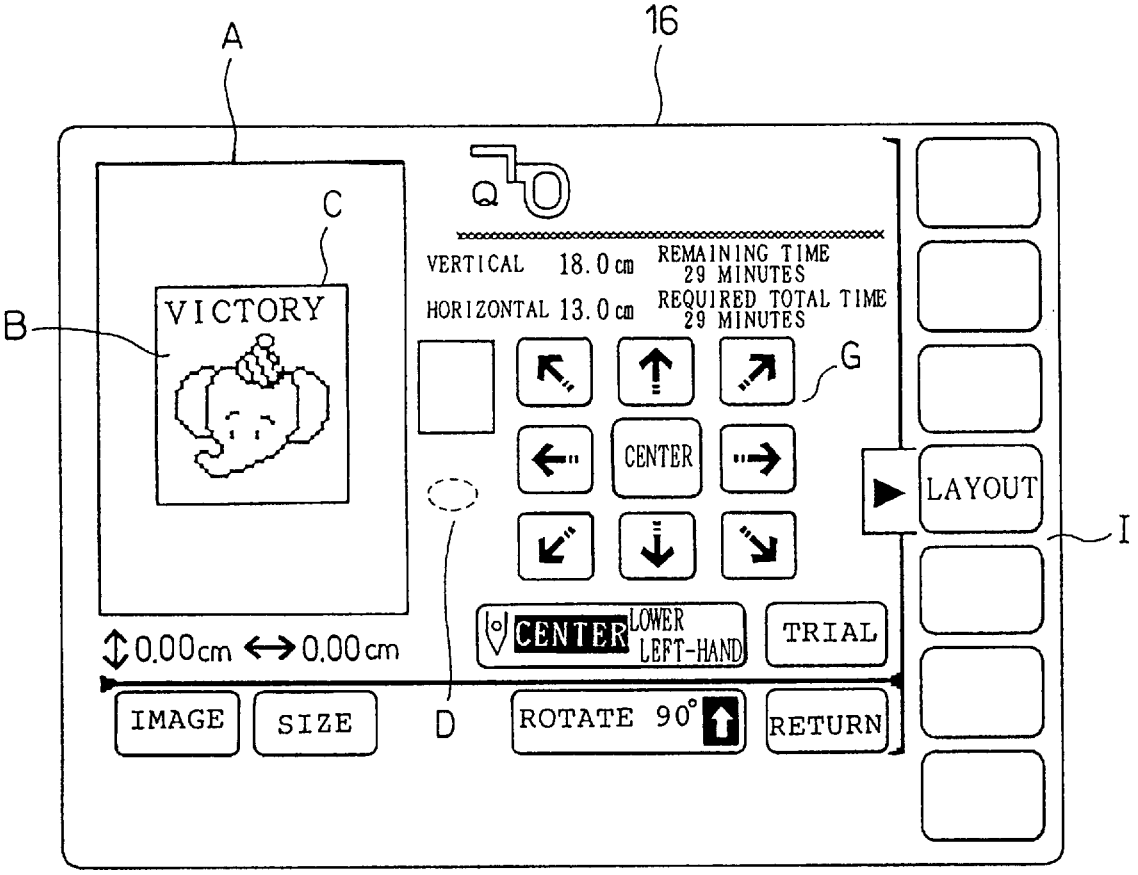
FIG. 10 is a view showing another layout screen.

A monochrome liquid crystal display (LCD) 16 is provided on the front surface of the arm 3. The LCD 16 serves as display means for displaying a variety of patterns and messages. The LCD 16 displays pattern selection screens as shown in FIGS. 7 and 8 and layout screens as shown in FIGS. 9 and 10 when the embroidering operation is to be performed, as will be described later. A touch panel 17 (shown only in FIG. 5) is provided on the surface of the LCD 16. The touch panel 17 includes various operation keys as well known in the art. The touch panel 17 comprises a number of transparent electrodes arranged vertically and horizontally and detects where the user touches it, as well known in the art.

A microcomputer-based control device 18 is provided in the machine main body 1 for controlling the various mechanisms described above, as shown in FIG. 5. The control device 18 includes an input interface 19, output interface 20, CPU 21, ROM 22 and RAM 23 all connected by a bus 24. The sewing machine motor 7, X-axis and Y-axis motors 13 and 11 of the embroidery frame moving mechanism 10, LCD 16, etc. are connected to the output interface 20 so as to be controlled by the control device 18. The touch panel 17 and start/stop key 14 are connected to the input interface 19 so that detection signals from the touch panel 17 and switch signals from the start/stop key 14 are delivered to the control device 18.

The ROM 22 stores control programs for controlling the embroidering operation and other normal sewing operations of the embroidery sewing machine, and a control program for controlling display of the LCD 16, a data processing program for performing various data processes such as readout and edit of embroidery data. The ROM 22 further stores pattern data for determining outlines of a number of embroidery patterns regarding the embroidering. In the embodiment, the ROM 22 stores pattern data for picture patterns and ornamental patterns formed by relatively simple shapes and for symbols and characters such as alphanumeric characters and Japanese "kana."

In the embodiment, the pattern data stored in the ROM 22 includes embroidery data required for the embroidering, display data formed from bit map data required for display of each pattern on the LCD 23, and appended data such as thread color data. The embroidery data is stored in the form of contour data for indicating an external outline or contour of each pattern. When the embroidering is to be executed, calculations are performed on the contour data to develop it into embroidery data indicating each stitch position, that is, amounts of movement of the workpiece cloth in the X-axis and Y-axis directions for each stitch. Furthermore, the same data can be used for both embroidery data and display data. Alternatively, either one set of the data can be stored and developed into the other set of data.

In the embodiment, furthermore, an external card ROM 25 is detachably connected to the control device 18. The external card ROM 25 stores pattern data including embroidery data, display data and appended color separation data corresponding to a number of relatively complicated picture patterns. To connect the external card ROM 25 to the control device 18, the user inserts it into a card insertion slot 26 provided in the right-hand side wall of the main body 1.

Based on the programs stored in the ROM 22 and selecting operations performed on the touch panel 17 by the user, the control device 18 controls the various mechanisms of the embroidery sewing machine so that the embroidering and other normal sewing operations are executed. As will be apparent from the following description, the control device 18 controls the LCD 16 to display thereon a variety of pattern selection screens, as shown in FIGS. 7 and 8, for displaying a plurality of individual patterns. These pattern selection screens are displayed on the LCD 16 in a mode in which the user selects desired patterns to be embroidered. The user can select one or more patterns by touching the touch panel 17. Accordingly, the touch panel 17 constitutes pattern selecting means in the present invention.

The control device 18 switches to a layout and edit mode upon selection of one or more patterns. The control device 18 then controls the LCD 16 so that a layout screen is displayed thereon. As shown in FIGS. 9 and 10, a layout region A representing a sewable region of the workpiece cloth defined by the large embroidery frame 9 is shown encompassed by a frame in a left-hand half portion of the layout screen. Furthermore, at least one selected embroidery pattern B encompassed by a rectangular frame C is displayed in the layout region A. The frame C represents a region occupied by the embroidery.

The layout region A is provided for the user to set and confirm a position of the embroidery to be formed on the workpiece cloth and is representative of a maximum sewable range in execution of the embroidering operation. Accordingly, the layout region A on the screen corresponds to a sewable range in the use of the large frame irrespective of the type of the attached embroidery frame 9. Furthermore, the size of each embroidery pattern B on the screen and an interspace between the embroidery patterns B on the screen are reduced or enlarged to correspond to a scale of the layout region A and sewable range. The embroidery pattern B is adapted to be located in the center of the layout region A in the initial state of the layout and edit mode subsequent to the pattern selection.

A display D representative of a usable frame is displayed on the right hand of the layout region A in the layout screen. Furthermore, various key displays used for the layout and edit of embroidery pattern B are displayed outside the layout region A in the layout screen so that an operation key display G is set on the touch panel 17. The operation key display G represents touched portions of the touch panel 17 in the form of images of operation buttons. By touching the operation key display G, the user can perform various editing processes on the selected embroidery pattern B in the layout region A. For example, the selected embroidery pattern B can be moved, rotated 90 degrees and changed in its size, that is, enlarged or reduced from the standard size, in the layout region A.

The control device 18 changes the display of embroidery pattern B and frame C in the layout region A according to the above-described editing processes. Consequently, an image matching an embroidery to be formed on the workpiece cloth is displayed in the layout region A. Viewing this image on the screen, the user can set a desired layout in which he or she wishes the embroidery pattern to be formed on the workpiece cloth. The control device 18 and touch panel 17 thus constitute layout means.

The usable frame display D representative of the usable frame includes an upper large frame display and a lower small frame display vertically arranged on the screen, as shown in FIGS. 9 and 10. The display D is displayed in a full-tone mode when the embroidery frame corresponding to the displayed one is usable, whereas it is displayed in a half-tone mode when the corresponding embroidery frame is unusable. Accordingly, only the large frame display is displayed in the full-tone mode with the small frame display being displayed in the half-tone mode when the embroidery pattern is relatively large in size. Both of the large and small frame displays are displayed in the full-tone when the embroidery pattern is relatively small.

The control device 18 obtains, by calculation by means of its software arrangement, a region occupied by the selected one or more patterns on the workpiece cloth. The occupied region corresponds to the frame display C. The control device 18 further judges whether the occupied region falls within a sewable range set in an inside region of the small frame. A plurality of sewable ranges are set to be each formed into a rectangular shape with four sides extending in the X-axis and Y-axis directions and to have different vertical and horizontal dimensions. Two sewable ranges are set in the embodiment.

When judging that the occupied region falls within either one of the sewable ranges, the control device 18 controls the LCD 16 so that the small frame display of the usable frame display D is displayed in the full-tone mode as well as the large frame display. On the other hand, when judging that the occupied region falls within neither of the sewable ranges, the control device 18 controls the LCD 16 so that the small frame display is displayed in the half-tone mode with the large frame display being displayed in the full-tone mode. Accordingly, the control device 18 constitutes occupied region obtaining means, range setting means, and judging means in the present invention. The usable frame display D of the LCD 16 constitutes informing means in the present invention.

A rectangular occupied region having a predetermined size is previously set for the character embroidery patterns irrespective of the types in the embodiment. In the case of a combination of character patterns, the occupied regions are simply added together into a single occupied region according to the number of characters. Furthermore, embroidery selecting operations are sequentially performed so that a number of character patterns are combined with one another so as to extend in the horizontal direction. When a resultant train of character patterns finally exceeds the layout region A, the embroidering cannot be performed even with the large frame. In such a case, the last character pattern exceeding the layout region A cannot be selected, and the informing operation is performed to that effect.

Figure 6:
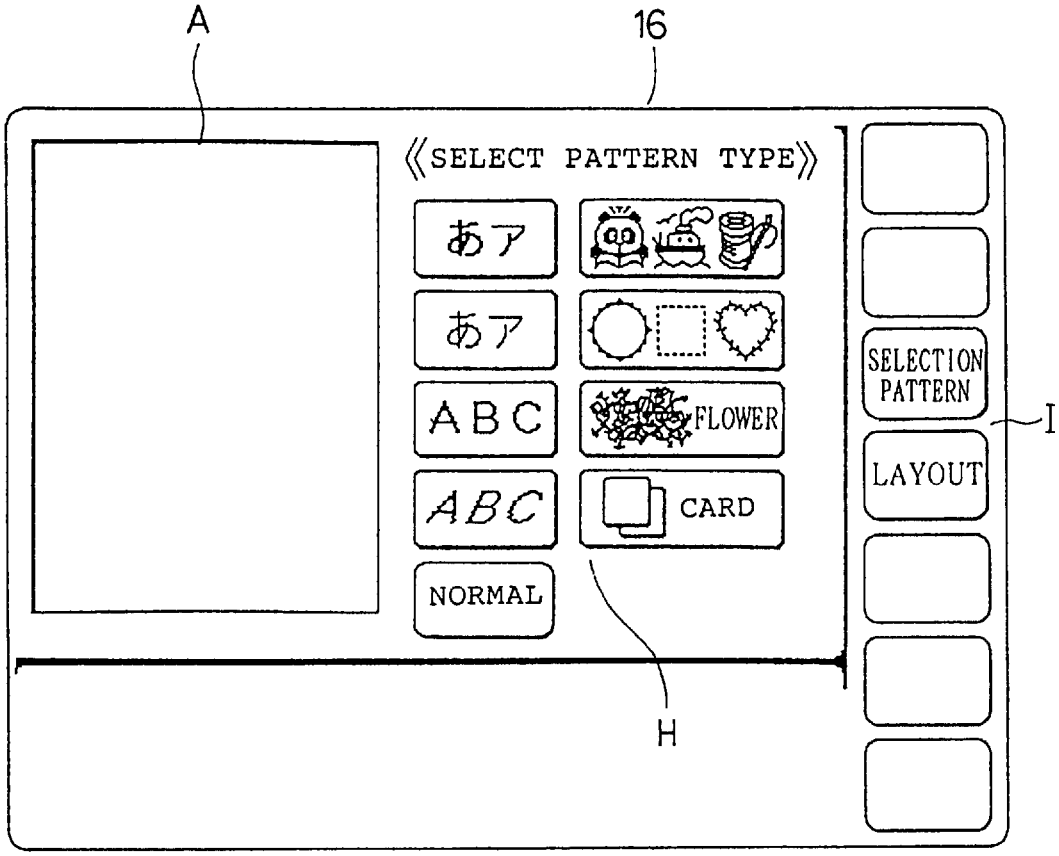
FIG. 6 is a view showing an initial screen of an LCD incorporated in the embroidery sewing machine.

The operation of the embroidery sewing machine will now be described. FIG. 2 shows the procedure of processing executed by the control device 18 from the time of power turn-on to the time of execution of sewing operation. An initial screen or a menu screen as shown in FIG. 6 is displayed on the LCD 16 when the power switch 15 of the main body 1 is turned on (step S1). The displayed menu screen includes a selection key display H. A plurality of embroidery patterns are divided into eight different pattern types. The selection key display H is provided for selecting any one of the pattern types or the normal sewing mode. A mode display I indicative of the current mode is usually displayed on the right-hand edge of the screen. When wishing to perform the normal sewing, the user touches a display key labeled "normal" (NO at step S2). Processing for the normal sewing is performed at step S3. The processing includes the selection of one of normal sewing modes and various setting operations. When the start/stop key 14 is subsequently turned on (YES at step S4), the sewing operation for the selected normal sewing mode is executed at step S5. Since the normal sewing is not the subject matter of the present invention, further description thereof will be eliminated.

When wishing to perform the embroidering operation, the user touches one of pattern type key displays on the touch panel 17 (YES at step S2). The screen of the LCD 16 is then switched to a pattern selection screen corresponding to the touched pattern type key display at step S6. FIG. 7 shows an example of pattern selection screen when an alphabetical pattern type key display, "ABC," has been touched. FIG. 8 shows another example of pattern selection screen when a picture pattern type key display has been touched. In each case, a pattern key display J is displayed which is provided for selecting one or more of a number of patterns.

Viewing the pattern selection screen, the user touches one or more key displays of the pattern key display J to select an embroidery to be sewn at step S7. For example, when the user wishes to embroider a character pattern group of "HAPPY," he or she selects "H," "A," "P," "P," and "Y" in this order by touching the corresponding key displays on the pattern selection screen of FIG. 7. When the user wishes to embroider a picture pattern of "elephant," he or she touches an "elephant" key display on the pattern selection screen of FIG. 8 to select the "elephant" picture pattern. Furthermore, when the user wishes to embroider a combination of the "elephant" picture pattern and a character pattern of "VICTORY," he or she selects the "elephant" picture pattern on the screen of FIG. 8 and the LCD 16 subsequently returns to the initial screen (YES at step S13). Thereafter, the characters, "V," "I," "C," "T," "O," "R" and "Y," are sequentially selected on the screen of FIG. 7.

Data of the pattern selected in the above-described manner is stored in the RAM 23 every time the pattern is selected at step S8. Furthermore, the size or occupied region of the selected pattern is obtained at step S9. When a plurality of patterns are selected, an addition of all the occupied regions is obtained. A predetermined occupied region is previously set in the case of a character pattern. On the other hand, a rectangular occupied region is obtained by calculation in the case of a picture pattern.

After obtaining the occupied region, the control device 18 judges whether the pattern falls within a sewable range of the large frame 9 at step S10. When judging that the pattern is beyond the sewable range (NO at step S10), the control device 18 cancels the selection of the pattern at step S11 and displays on the screen to the effect that the selected pattern is beyond the sewable range, at step S12.

The user touches a key display labeled "LAYOUT" in the mode display I at step S14 when wishing to confirm the selected pattern or to lay out and edit the selected pattern. When neither confirmation nor layout and edit is necessary, the start/stop key 14 is turned on (YES at step S15) so that the sewing or embroidery forming operation is executed.

On the other hand, when the "LAYOUT" key display is touched (YES at step S14), the LCD 16 displays a layout screen as shown FIG. 9 or 10 at step S16. The layout region A representing the region defined by the large embroidery frame 9 is displayed on the layout screen. Furthermore, one or more selected embroidery patterns B are displayed within the layout region A, encompassed by the rectangular frame C corresponding to the occupied region. Additionally, the operation key display G including various touch key displays relating to the layout and edit of the embroidery pattern B is displayed outside the layout region A on the screen. The usable frame display D is also displayed on the screen. Either one or both of the large and small frame displays are displayed in the full-tone or half-tone mode depending upon whether the respective corresponding frames are usable or not, as described above. The usable frame display D is based on the processing at the subsequent step S17. The processing at step S17 is shown in FIG. 1 and will be described in detail later.

When one or more of the key displays of the operation key display G are touched at step S18, the processing of layout and editing is performed at step S19. In the processing, for example, the selected embroidery pattern B is moved, rotated 90 degrees and enlarged or reduced from the standard size, in the layout region A. The occupied region B within the layout region A is moved or rotated according to the operation for the processing. Consequently, the user can set a desired layout. For example, in FIG. 10, the character pattern, "VICTORY," can be disposed above or below the "elephant" picture pattern. Thereafter, when the user operates the start/stop key 14 with the workpiece cloth being set on the embroidery frame 9 (YES at step S20), the sewing operation is performed at step S5 so that an embroidery corresponding to an image displayed within the layout region A is formed on the workpiece cloth.

Figure 1:
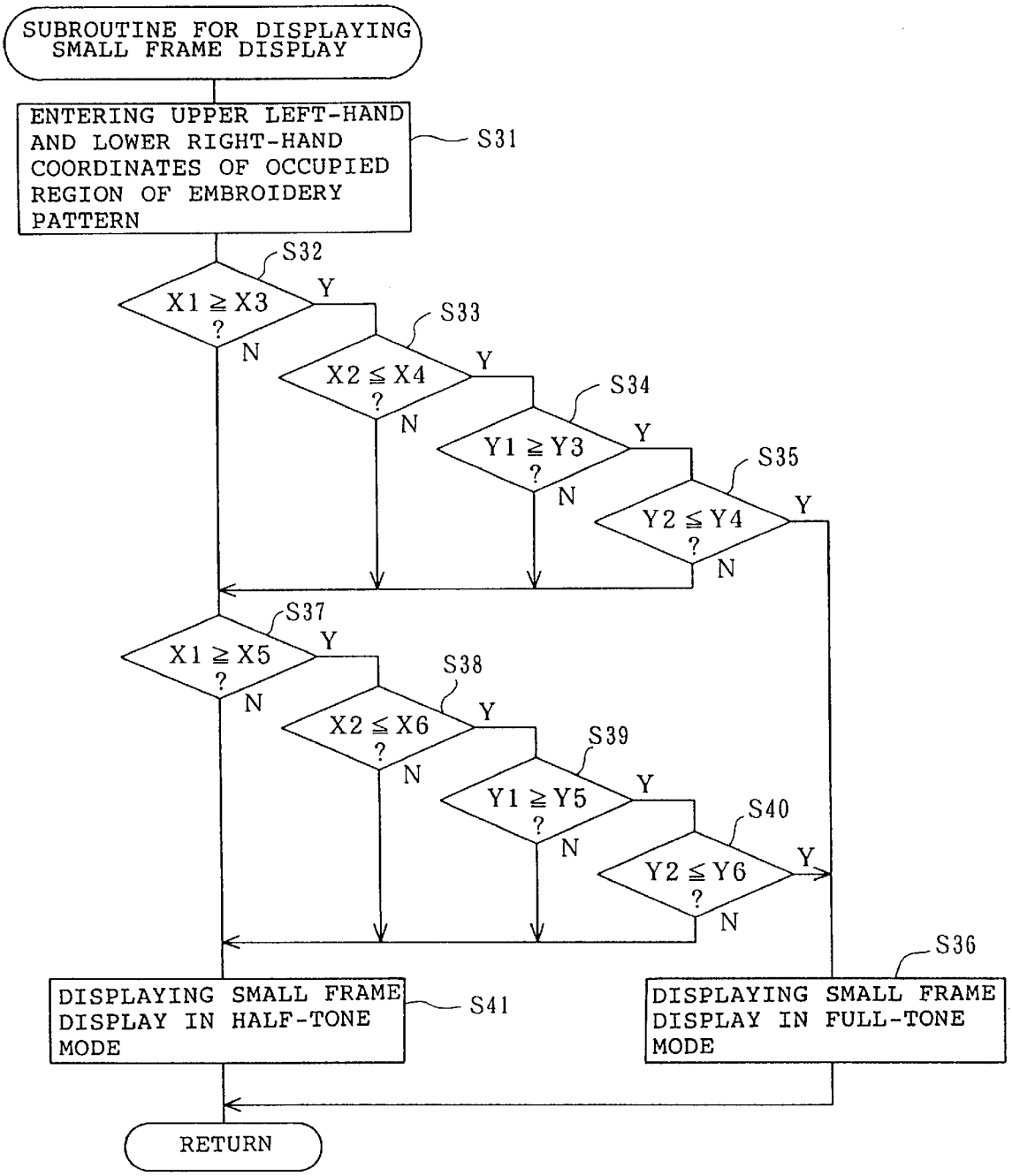
FIG. 1 is a flowchart showing a subroutine for controlling display of a usable frame in the embroidery sewing machine of a first embodiment in accordance with the present invention.

FIG. 1 shows a subroutine for controlling display of the small frame display of the usable frame display D. First, as shown in FIG. 3, a sewable range in the case where the small frame is used in the embroidering is an elliptic range E which is shown by imaginary line since it is not actually displayed. The control device 18 automatically sets a sewable range within the elliptic range E. More specifically, the control device 18 sets two rectangular sewable regions F1 and F2 having different vertical and horizontal dimensions. These sewable regions F1 and F2 are also shown by imaginary line since they are not actually displayed.

In the frame display subroutine of FIG. 1, the control device 18 enters the coordinates, (X1, Y1), of the upper left-hand corner of the rectangular occupied region C of the selected embroidery pattern at step S31. The control device 18 further enters the coordinates, (X2, Y2), of the lower right-hand corner of the region C. Regarding the setting of coordinate plane, as shown in FIG. 3, the X and Y coordinates take the respective minimum values at the upper left-hand corner of the sewable range (layout region A) corresponding to the large frame. The value of the X coordinate is increased as it goes rightward therefrom and the value of the Y coordinate is increased as it goes downward therefrom, as viewed in FIG. 3.

Upon input of the coordinates of the corners of the occupied region C, the control device 18 judges whether the occupied region C falls within the horizontally long sewable range F1 at steps S32 to S35. In the judgment, the coordinates (X3, Y3) of the upper left-hand corner of the sewable range F1 and the coordinates (X4, Y4) of the lower right-hand corner of the sewable range F1 are compared with the above-described coordinates of the corners of the occupied region C respectively. The control device 18 judges that the occupied region C falls within the sewable range F1 when the coordinate X1 is equal to or larger than the coordinate X3 at step S32, the coordinate X2 is equal to or smaller than the coordinate X4 at step S33, the coordinate Y1 is equal to or larger than the coordinate Y3 at step S34, and the coordinate Y2 is equal to or smaller than the coordinate Y4 (YES at step S35). Thus, since the embroidery pattern B can be embroidered with the small frame, the small frame display is displayed in the full-tone mode in the usable frame display D at step S36.

On the other hand, when judging that the occupied region C is beyond the sewable range F1 (NO at any one of steps S32 to S35), the control device 18 judges whether the occupied region C falls within the vertically long sewable range F2 at steps S37 to S40. This judgment is also based on the comparison of coordinates as described above. That is, the control device 18 judges that the occupied region C falls within the sewable range F2 when the coordinate X1 is equal to or larger than the coordinate X5 at step S37, the coordinate X2 is equal to or smaller than the coordinate X6 at step S38, the coordinate Y1 is equal to or larger than the coordinate X5 at step S39, and the coordinate Y2 is equal to or smaller than the coordinate X6 (YES at step S40). Consequently, the small frame display is displayed in the full-tone mode as well as the large frame display at step S36.

FIG. 9 shows an example of the case where the small frame can be used. Regarding the embroidery pattern B of the character pattern, "HAPPY," for example, the occupied region C falls within the sewable range F2. Consequently, the small frame display of the usable frame display C is displayed in the full-tone mode. Furthermore, the picture patterns such as the "elephant" pattern are larger than the character patterns. Accordingly, the occupied region C falls within neither of the sewable ranges F1 and F2 with respect to most of the picture patterns. However, the small frame can be used with respect to some of the picture patterns shown in FIG. 8, for example, an "open convertible" pattern.

On the other hand, when the occupied region C is beyond the sewable range F2 (NO at any one of steps S37 to S40), the control device 18 judges that the embroidery pattern B cannot be embroidered with the small frame. Accordingly, the small frame display of the usable frame display D is displayed in the half-tone mode at step S41. FIG. 10 shows an example of the case where the embroidery pattern B cannot be embroidered with the small frame. The embroidery pattern B shown in FIG. 10 is a combination of the "elephant" picture pattern and the "VICTORY" character pattern. Since the occupied region C is excessively large in this case, the control device 18 judges that the occupied region C falls within neither of the sewable ranges F1 and F2. Consequently, the small frame display is displayed in the half-tone mode. Viewing the usable frame display C, the user can select the embroidery frame 9 to be used.

The judgment as to whether the small frame can be used is also performed after the layout and edit processing (step S19 in FIG. 2) though this is not described in detail. Consequently, the displaying operation is performed in the usable frame display D every time an alteration in layout or rotation of the embroidery pattern B renders the small frame usable or unusable, for example.

Figure 11:
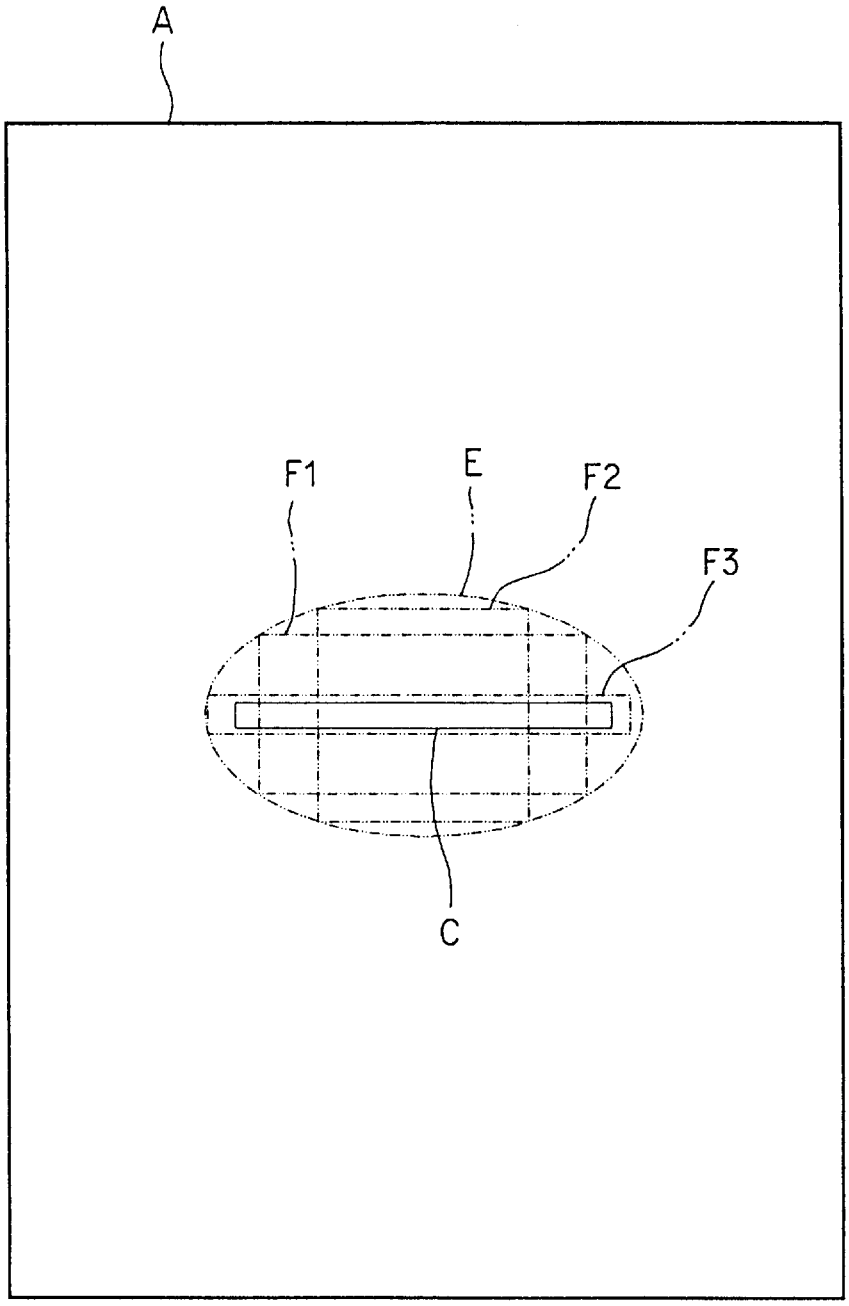
FIG. 11 is a view similar to FIG. 3, showing a second embodiment in accordance with the present invention.

The rectangular sewable ranges F1 and F2 are set although an embroidery can originally be formed within the elliptic region E in FIG. 11 with respect to the small frame. This setting would be considered to increase a dead space. However, although the dead space is increased in the individual sewable ranges F1 and F2, each of the sewable ranges F1 and F2 is set so as to cover a broader range of the region defined by the small frame. Consequently, the dead space can be rendered as small as possible.

Differing from the prior art in which the dead space is increased, the above-described embodiment of the present invention can render the dead space as small as possible when an embroidery pattern is formed on the workpiece cloth. Furthermore, the freedom in the layout of embroidery pattern B can be improved.

Moreover, the control device 18 judges whether the embroidery pattern B, for which a desired layout has been performed by the user, falls within either one or both of the sewable ranges F1 and F2. Consequently, the convenience in using the embroidery sewing machine can be improved. Furthermore, since the occupied region of one character pattern is previously determined, the calculation to obtain the occupied region can be simplified when the embroidery pattern B is composed of a combination of character patterns. Additionally, since each of the sewable ranges F1 and F2 is set to be rectangular, the judgment executed by the control device can be simplified.

FIG. 11 illustrates a second embodiment of the invention. The second embodiment differs from the first embodiment in that three rectangular sewable ranges F1, F2 and F3 are set with respect to the small frame. The provision of the three sewable ranges can further reduce the dead space. Consequently, a determination can be made that the small frame can be used for an embroidery pattern having a horizontally slender occupied region C as shown in FIG. 11.

Figure 12:
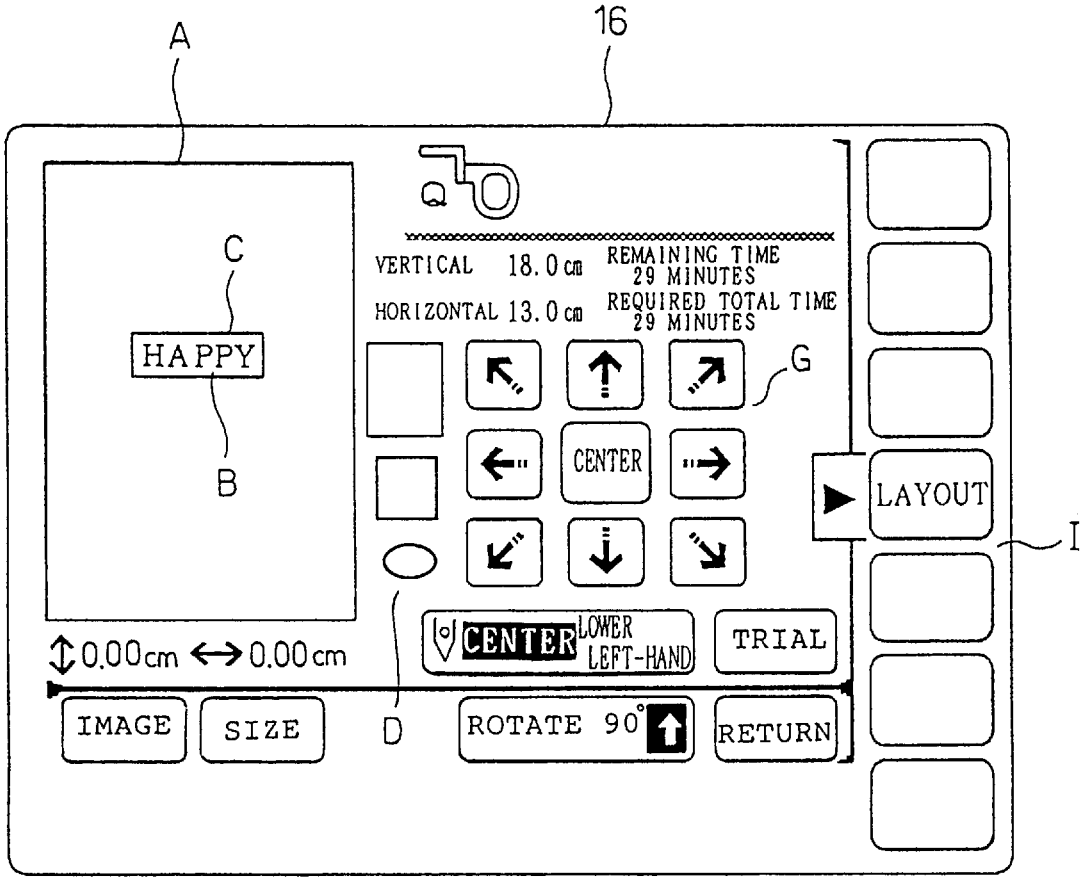
FIG. 12 is a view similar to FIG. 9, showing a third embodiment in accordance with the present invention.

FIG. 12 illustrates a third embodiment of the invention. The identical parts are labeled by the same reference symbols in the third embodiment as in the first embodiment. The third embodiment differs from the first embodiment in that three types of frames, that is, a large frame, middle frame and small frame, constitute the embroidery frame 9. More specifically, as shown in FIG. 12, a middle frame display is displayed between the large and small frame displays of the usable frame display D on the layout screen. The middle frame display is a size smaller than the large frame display and is formed into a generally square frame. When the control device judges that the middle frame can be used for the selected embroidery pattern B, the middle frame display is displayed in the full-tone mode in the usable frame display D. On the other hand, when the control device judges that the middle frame cannot be used, the middle frame display is displayed in the half-tone mode in the usable frame display D. The other arrangement in the third embodiment is the same as in the first embodiment. Accordingly, substantially the same effect can be achieved in the third embodiment as in the first embodiment.

Figure 13:
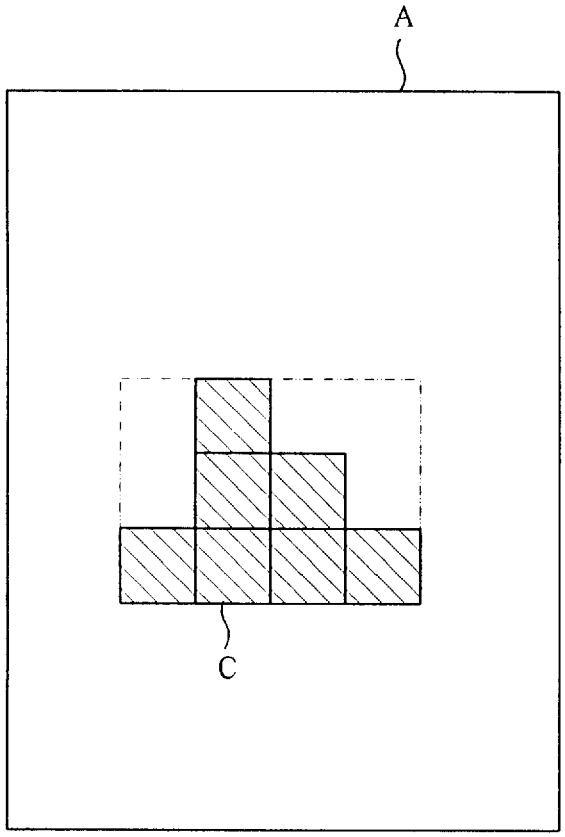
FIG. 13 is a view showing a manner of setting and judging the sewable range in a fourth embodiment in accordance with the present invention.
Figure 14:
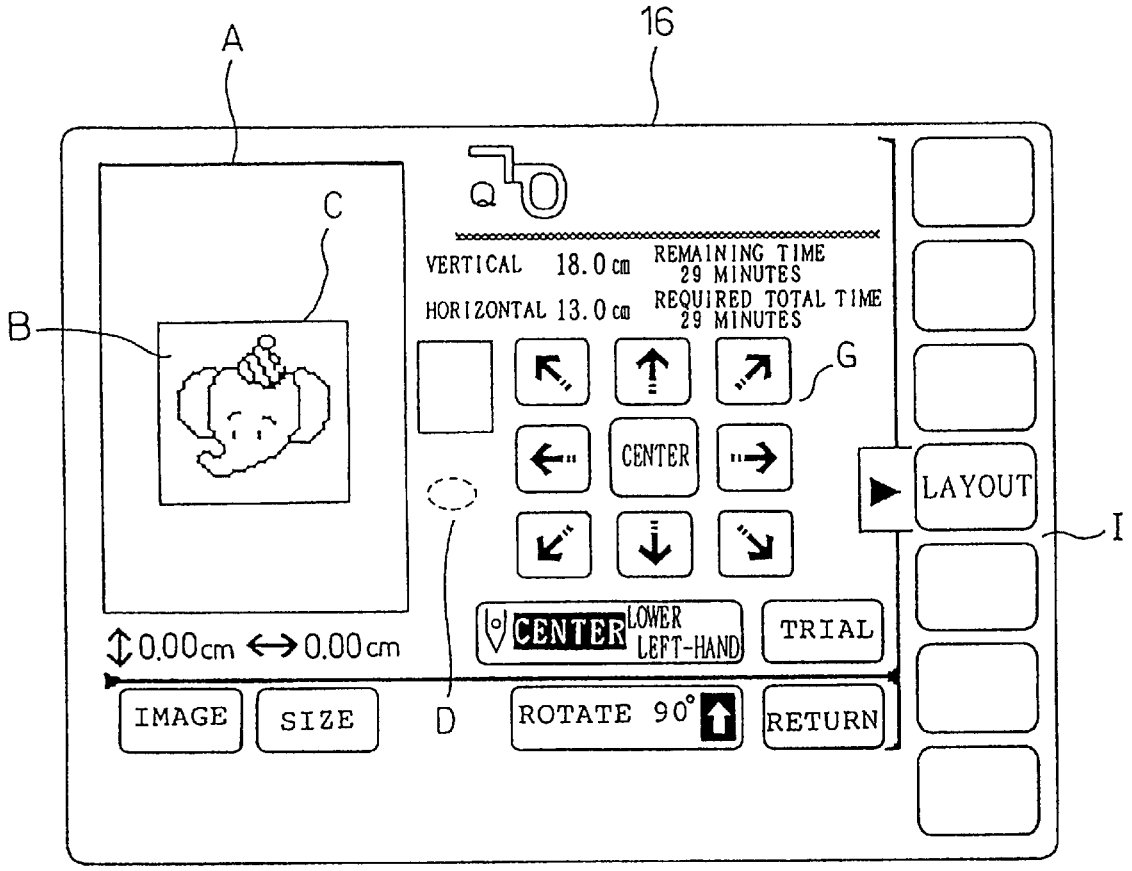
FIG. 14 PRIOR ART
FIG. 14 is a view similar to FIG. 9, showing the prior art.
Figure 15:
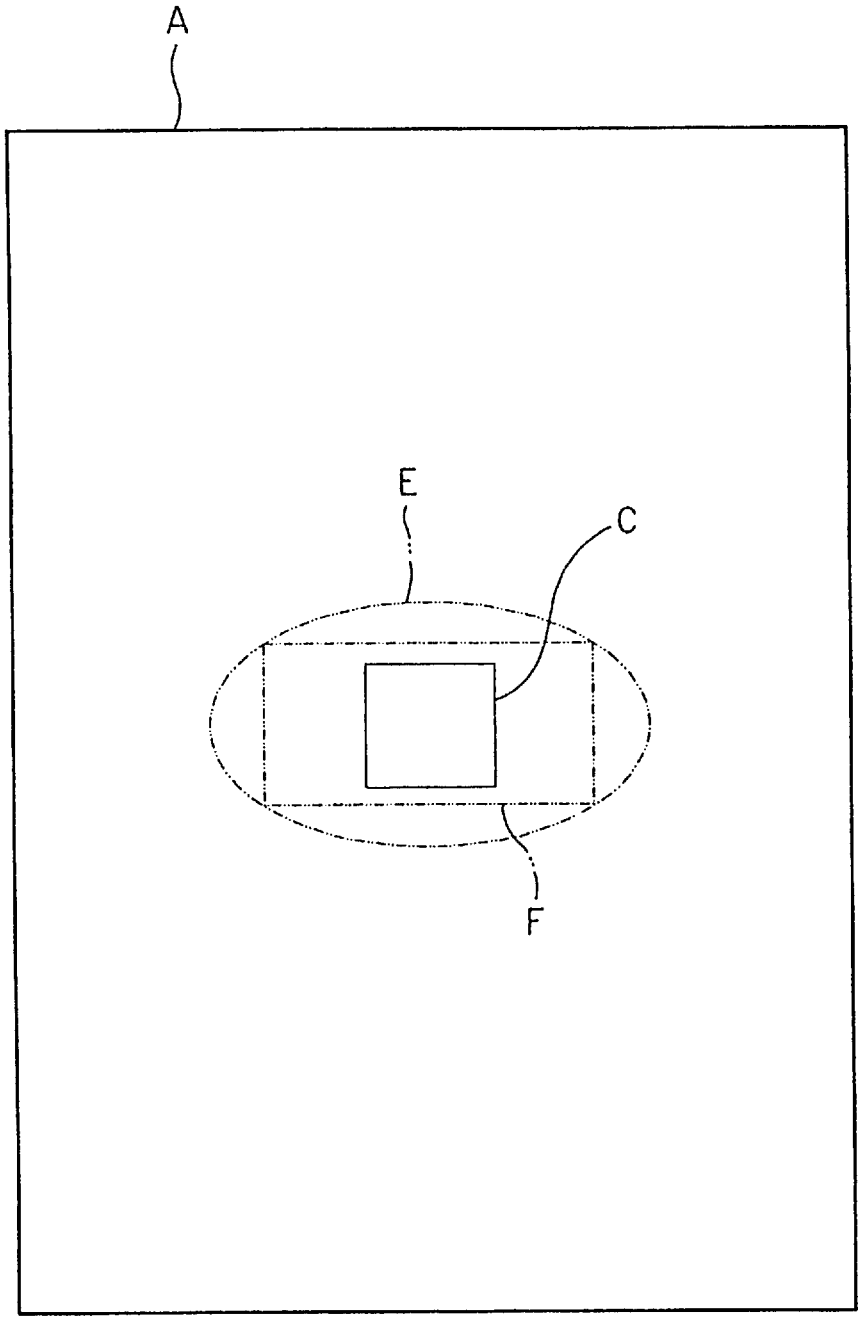
FIG. 15 PRIOR ART
FIG. 15 is a view similar to FIG. 3, showing the prior art.

FIG. 13 illustrates a fourth embodiment of the invention. The identical parts are labeled by the same reference symbols in the fourth embodiment as in the first embodiment. Assume now that a plurality of character and picture patterns are selected to be combined together and edited (or laid out) so that the occupied regions of the respective patterns are combined into a whole occupied region C represented by oblique lines in FIG. 13. In the first embodiment, the occupied region C having the configuration shown by oblique lines is re-set into a rectangular occupied region as shown by two dot chain line in FIG. 13. The control device judges whether the rectangular occupied region falls within either one or both of the sewable ranges F1 and F2.

On the other hand, in the fourth embodiment, the control device judges whether the occupied region shown by solid line in FIG. 13 falls within the sewable ranges F1 and F2. More specifically, the control device judges whether each of a plurality of square partial occupied regions constituting the occupied region C shown by solid line falls within the sewable ranges F1 and F2. When at least any one of the square partial occupied region is beyond the sewable ranges F1 and F2, the control device judges that the small frame cannot be used with respect to the solid line occupied region. The control device judges that the small frame can be used with respect to the solid line occupied region when all the square partial occupied regions fall within the sewable range F1 or F2. The other arrangement in the fourth embodiment is the same as in the first embodiment. Accordingly, substantially the same effect can be achieved in the fourth embodiment as in the first embodiment. Particularly in the fourth embodiment, the occupied region C of the combined and laid out patterns has the configuration as shown by solid line in FIG. 13. Consequently, a more reliable judgment as to whether the embroidery pattern can be embroidered can be made in the fourth embodiment as compared with the first embodiment.

Although two or three sewable ranges are set in the foregoing embodiments, four or more sewable ranges may be set. Consequently, the dead space can further be rendered smaller. Furthermore, four or more types of embroidery frames 9 may be provided. A function may be provided of automatically detecting the type of embroidery frame 9 currently attached to the embroidering unit 8. Alternatively, a function may be provided so that the user enters the type of the embroidery frame 9. In either case, the control device judges whether the embroidery frame 9 is suitable for the selected embroidery pattern B. The result of judgment is informed of. The result of judgment is preferably displayed on the screen of the LCD 16.

Although the rectangular and elliptic embroidery frames 9 are used in the foregoing embodiments, a circular embroidery frame may be used. In this regard, the large frame may also be circular or elliptic. Furthermore, a plurality of sewable ranges may be set with respect to the large frame in the same manner as described above, and the control device may judge whether the selected embroidery pattern falls within the individual sewable ranges. Additionally, although the occupied region of the embroidery pattern is rectangular in the foregoing embodiments, the occupied region may have a configuration more closely resembling the outer configuration of the embroidery pattern, for example, a polygonal, elliptic or circular configuration.

In the foregoing embodiments, the CPU 21 (namely, the control device 18) is operated on the basis of the programs stored in the ROM 22 so that the means for obtaining the occupied region, range setting means and judging means are accomplished. However, electronic circuits (occupied region obtaining circuit, range setting circuit and judging circuit) for accomplishing the functions of the occupied region obtaining means, range setting means and judging means may be composed of hardware such as gate circuits and provided in the embroidery sewing machine or the control device thereof, instead.

Although the ROM 22 stores the programs to accomplish the occupied region obtaining means, range setting means and judging means in the foregoing embodiments, the programs may be stored in an external card ROM so that the CPU 21 (namely, the control device 18) is operated on the basis of the programs stored in the external card ROM, instead. Furthermore, the embroidery sewing machine may be provided with a hard disk system and a floppy disk drive so that the programs are stored in the hard disk system. In this case, the programs are preferably stored in a floppy disk, and the floppy disk is preferably attached to the floppy disk drive so that the programs are installed on the hard disk system of the embroidery sewing machine. Furthermore, the programs may be stored in a CD-ROM and the embroidery sewing machine may be provided with a CD-ROM drive so that the programs are installed through the CD-ROM on the embroidery sewing machine. Additionally, a recording medium for storing the programs should not be limited to the external card ROM, floppy disk and CD-ROM. Other recording media may be used for the purpose.

Although the present invention is applied to the household embroidery sewing machine in the foregoing embodiments, the invention may be applied to embroidery sewing machines for industrial use. The invention may also be applied to the industrial embroidery sewing machines of the type in which a control device such as a personal computer for processing the embroidery data is discrete from the sewing machine body. Furthermore, although the embroidery frame is moved in the foregoing embodiments, the needle side may be moved horizontally or in the X-axis and Y-axis directions, instead. Additionally, both of the embroidery frame and the needle bar may be moved horizontally.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. An embroidery sewing machine comprising:

an embroidery frame for holding a workpiece cloth;

a needle bar;

a moving mechanism for moving either one or both of the embroidery frame and the needle bar relative to the other or each other so that an embroidery pattern is formed on the workpiece cloth;

pattern selecting means for selecting an embroidery pattern to be formed;

means for obtaining an occupied region within the workpiece cloth occupied by the embroidery pattern selected by the pattern selecting means;

range setting means for automatically setting a plurality of different sewable ranges in a region inside the embroidery frame;

judging means for judging within which of the sewable ranges set by the range setting means the occupied region of the selected embroidery pattern falls; and informing means for informing a result of judgment by the judging means.

2. An embroidery sewing machine according to claim 1, further comprising layout means for laying out the selected embroidery pattern so that the selected embroidery pattern is set on a desired location within the region inside the embroidery frame, and wherein the judging means judges within which of the sewable ranges set by the range setting means the occupied region of the embroidery pattern laid out by the layout means falls.

3. An embroidery sewing machine according to claim 1, wherein the embroidery patterns include a plurality of character patterns each having a rectangular occupied region of a predetermined size.

4. An embroidery sewing machine according to claim 2, wherein the embroidery patterns include a plurality of character patterns each having a rectangular occupied region of a predetermined size.

5. An embroidery sewing machine according to claim 1, wherein the region inside the embroidery frame is circular or elliptic and the sewable ranges are rectangular.

6. An embroidery sewing machine according to claim 2, wherein the region inside the embroidery frame is circular or elliptic and the sewable ranges are rectangular.

7. An embroidery sewing machine according to claim 3, wherein the region inside the embroidery frame is circular or elliptic and the sewable ranges are rectangular.

8. An embroidery sewing machine according to claim 1, wherein the informing means comprises a liquid crystal display (LCD).

9. An embroidery sewing machine according to claim 1, further comprising a plurality of different embroidery frames, and wherein the range setting means automatically sets the plurality of different sewable ranges in a region inside each embroidery frame, and wherein the judging means judges within which of the sewable ranges set by the range setting means the region occupied by the selected embroidery pattern falls for each of the embroidery frames.

10. An embroidery sewing machine according to claim 1, further comprising a plurality of different embroidery frames, and embroidery frame detecting means for detecting the embroidery frame attached to a main body of the machine, and wherein the range setting means automatically sets the plurality of different sewable ranges in a region inside the embroidery frame detected by the embroidery frame detecting means.

11. An embroidery sewing machine according to claim 5, wherein the occupied region of the selected embroidery pattern is set to be rectangular.

12. An embroidery sewing machine according to claim 11, further comprising embroidery pattern editing means for selecting and editing a plurality of embroidery patterns, and wherein the occupied region of each of the post-edited embroidery patterns is set to be rectangular when the plurality of embroidery patterns have been selected and edited.

13. An embroidery sewing machine according to claim 11, further comprising embroidery pattern editing means for selecting and editing a plurality of embroidery patterns, and wherein the occupied regions of the respective embroidery patterns are edited so as to have a configuration formed by merging the occupied regions of the respective embroidery patterns, and wherein the judging means judges within which of the sewable ranges set by the range setting means the occupied region of each of the plurality of embroidery patterns falls.

14. An embroidery sewing machine comprising:

an embroidery frame for holding a workpiece cloth;

a needle bar;

a moving mechanism for moving either one or both of the embroidery frame and the needle bar relative to the other or each other so that an embroidery pattern is formed on the workpiece cloth;

a pattern selecting device for selecting an embroidery pattern to be formed;

a circuit for obtaining an occupied region within the workpiece cloth occupied by the embroidery pattern selected by the pattern selecting device;

a range setting circuit for automatically setting a plurality of different sewable ranges in a region inside the embroidery frame;

a judging circuit for judging within which of the sewable ranges set by the range setting circuit the occupied region of the selected embroidery pattern falls; and an informing device for informing a result of judgment by the judging circuit.

15. A storage medium for storing a program for operating an embroidery sewing machine, the program accomplishing the functions of:

means for obtaining an occupied region within a workpiece cloth occupied by an embroidery pattern selected;

range setting means for automatically setting a plurality of different sewable ranges in a region inside an embroidery frame; and judging means for judging within which of the sewable ranges set by the range setting circuit the occupied region of the selected embroidery pattern falls.

16. A storage medium according to claim 15, wherein the program further accomplishes the functions of:

layout means for laying out the selected embroidery pattern so that the selected embroidery pattern is set on a desired location within the region inside the embroidery frame; and judging means for judging within which of the sewable ranges set by the range setting means the occupied region of the embroidery pattern laid out by the layout means falls.

* * * * *